United States Patent [19]

Diels

[11] 4,123,898

[45] Nov. 7, 1978

[54] COUNTERWEIGHT SHELL FOR CLOCKS

[76] Inventor: Paul C. Diels, 6909 Lahser Rd., Birmingham, Mich. 48010

[21] Appl. No.: 681,120

[22] Filed: Apr. 28, 1976

[51] Int. Cl.[2] ..... G04B 17/02

[52] U.S. Cl. ..... 58/129; 58/132

[58] Field of Search ..... 58/7, 8, 129, 132

[56] References Cited

U.S. PATENT DOCUMENTS

| | | | |
|---|---|---|---|
| 653,712 | 7/1900 | Thrasher | 58/7 |
| 783,747 | 2/1905 | Getty | 58/132 |
| 930,664 | 8/1909 | Hazzard | 58/129 |

FOREIGN PATENT DOCUMENTS

| | | | |
|---|---|---|---|
| 268,635 | 4/1927 | United Kingdom | 58/132 |

*Primary Examiner*—Robert K. Schaefer
*Assistant Examiner*—Vit W. Miska
*Attorney, Agent, or Firm*—Cullen, Sloman, Cantor, Grauer, Scott, & Rutherford

[57] ABSTRACT

A counterweight shell for clocks includes an elongated body of cylindrical shape, open at one end and having a bottom wall as an integral part of the body and having a central aperture. A rod with its opposite ends threaded is axially nested within said body with one end projected through said bottom wall, and receives a nut threaded thereon which bears against said bottom wall. A top cap having a central aperture and an integral annular flange is nested over the open end of the body, with the other end of the rod projected through said cap. A hook having an apertured shank receives and is threaded over the rod other end to retainingly engage the cap. The bottom wall has a central portion which is axially indented into the body for completely enclosing said nut. The body, bottom wall and cap are of aluminum, the body and bottom wall being drawn or extruded. The outer surface of the body, bottom wall and cap are annodized to a color simulating brass. The invention further includes the method of making such counterweight shell which comprises deep drawing or extruding an aluminum disc to form an elongated body of cylindrical shape open at one end and having an integral bottom wall. A further step includes the stamping of aluminum cap to have an annular flange. A further step includes brushing the body, bottom wall and cap and a final step includes annodizing the body, bottom wall and cap to a color simulating brass. The shell and cap may be made of brass.

1 Claim, 2 Drawing Figures

COUNTERWEIGHT SHELL FOR CLOCKS

BACKGROUND OF THE INVENTION

Heretofore, counterweight shells for clocks have been constructed from brass tubes open at both ends and requiring removable flanged brass caps at both ends. The brass is costly as is the additional stop of forming a pair of covers out of brass. Heretofore, the bottom cap was flat so that the securing nut for the rod that extends through the body projected below the bottom wall so that the body during assembly would not stand up. This made it difficult to protect the body against scratching or other damgage. Similarly tipping and scratching occurred when the clock unwound and the shell would not stand up upon the clock bottom.

SUMMARY OF THE INVENTION

It is an object of the present invention to eliminate the use of brass in the forming of counterweight shells and instead, provide a counterweight shell which is deep drawn or extruded aluminum in the form of a tube open at one end and having an integral bottom wall.

It is a further object to therefor provide a single flanged cap for the single open end of the counterweight shell.

It is a further object to provide an indented bottom wall for the shell so as to protectively enclose and conceal the securing nut so that during the assembly the counterweight shell can be mounted in an upright position upon a table or support, and further the shell would rest in an upright position upon the clock floor, when unwound.

It is another object to still make the shell of brass with integral bottom wall and within an indentation therein to enclose the nut.

It is a further object to provide a counterweight shell which will not tanish as does brass and wherein the cost of production thereof is reduced one-third.

It is a further object to provide a method of making counterweight shells for clocks which comprises deep drawing or extruding an aluminum disc to form an elongated body with an integral bottom wall, open at one end. Further steps include stamping an aluminum cap with an annular flange; brushing the body, bottom wall and cap and thereafter annodizing same to a color simulating brass.

These and other objects will be seen from the following specification and Claims in conjunction with the appended drawing.

THE DRAWING

DETAILED DESCRIPTION OF THE INVENTION

Figure 1:
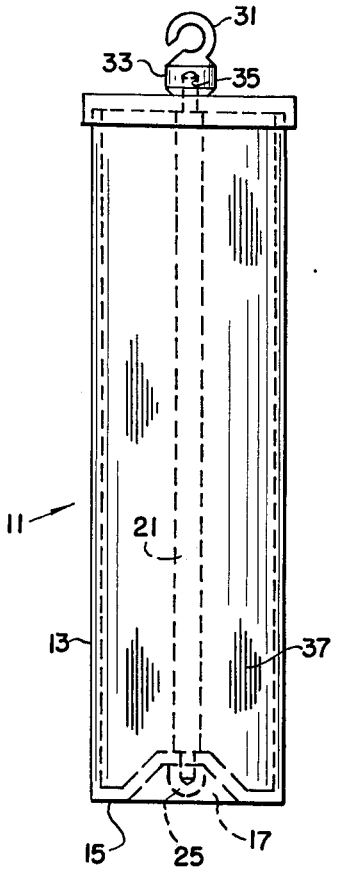
FIG. 1 is a side elevational view of the present counterweight shell for clocks.

It will be understood that the above drawing illustrates merely a preferred embodiment of the invention, and that other embodiments are contemplated within the scope of the Claims hereafter set forth.

Referring to the drawing, the present counterweight shell for clocks, including grandfather clocks and the like, is generally designated at 11 and includes an elongated cylindrical body 13 of deep drawn or extruded aluminum.

The body includes an integral bottom wall 15 having an axial indentation or recess portion 17 with a central punched aperture 19.

A rod 21, preferably of steel, is threaded at its opposite ends at 23 and 24 and is normally axially disposed within the body with its lower threaded end projected through aperture 19 to receive the nut 25. Said nut throughout its height is nested within the bottom wall indentation 17 and bears against said bottom wall. Said nut is preferably made of brass.

A stamped cap 27 of aluminum has an annular flange 28 and is adapted to loosely nest over the upper open end of said body, and is centrally apertured at 29.

Figure 2:
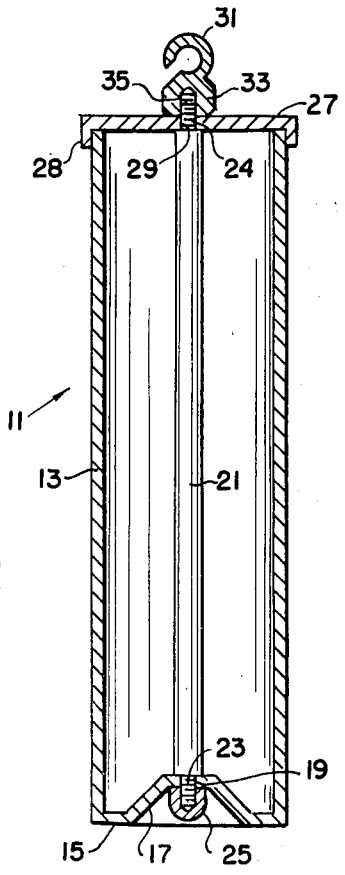
FIG. 2 is a vertical section thereof.

In the assembly of the cap over the open end of the body, the threaded end 24 of the rod is manipulated to a central axial position by applying manual pressure to the nut 25, until said threaded end is in registry with aperture 29 of the cap and passes therethrough. Hook 31 of brass includes shank 33 which has an internally threaded bore 35 which receives and is threaded over the upper threaded end of rod 21 into retaining engagement with said cap. In accordance with the present method of making the counterweight shell, the steps of manufacture include the following:

1. Deep drawing or extruding an aluminum disc to form the cylindrical body 13, FIGS. 1 and 2, which is open at its upper end and has the integral bottom wall 15 with its axial indentation 17. Aperture 19 is punched through the indentation.

2. Stamping an aluminum cap 27 including an integral annular flange 28 to cover the open end of the body.

3. Brushing the body, bottom wall 15 and cap 27.

4. Annodizing the complete assembly including the body, bottom wall and cap to a color simulating brass. The brushed and annodized outer surface of the body, bottom wall and cap is designated at 37, FIG. 1.

Heretofore, the present counterweight shells have all been made in Europe from open-ended brass tubing. This, of course, required the formation of a pair of brass top and bottom caps with annular flanges, all of which contributed to an excessive cost of manufacture. By the present construction employing a drawn or extruded aluminum, and annodizing to a brass color, the cost of the product is reduced one-third.

The final annodized aluminum product has a longer life than the brass and does not become tarnished as does brass. Heretofore, using a separate bottom cap, should that cap fall off for any reason, the heavy cylindrical weight within the shell will drop out causing damage. In the present construction, the bottom wall of the body is an integral part of the body so that the weight cannot drop out. Normally, brass shells are required to be replaced every four or five years due to tarnishing. The cost of replacement is high. Aluminum as annodized does not tarnish and maintains the brass appearance indefinitely.

It is contemplated that the shell 13 and integral bottom wall 15 may be constructed of brass; and the cap 27–28 be of brass.

Having described my invention, reference should now be had to the following claims.

I claim:

1. A counterweight shell for clocks comprising an elongated hollow body of cylindrical shape, open at one end, a bottom wall as an integral part of the body and having a central aperture;

a rod with its opposite ends threaded, axially nested within said body with one end projected through said bottom wall;

a nut threaded over said rod one end and bearing against said bottom wall;

a top cap having a central aperture and an integral annular flange nested over the open end of said body;

the other end of said rod projected through said cap;

and a hook having an apertured shank receiving and threaded onto said rod other end and retainingly engaging said cap;

said bottom wall having a central portion indented into said body, said nut along its height being completely enclosed within said indentation; and said body, bottom wall and cap being of brass.

* * * * *